United States Patent [19]

Evert et al.

[11] Patent Number: 4,704,886

[45] Date of Patent: Nov. 10, 1987

[54] STRETCH-FORMING PROCESS

[75] Inventors: Robert P. Evert, Gibsonia; James A. Miller, Apollo, both of Pa.

[73] Assignee: Aluminum Company of America, Pittsburgh, Pa.

[21] Appl. No.: 725,897

[22] Filed: Apr. 22, 1985

[51] Int. Cl.[4] ..... B21D 7/02; B21D 11/02; B29C 53/08; B29C 55/22

[52] U.S. Cl. ..... 72/57; 72/296; 72/369; 264/291; 264/292; 264/294; 264/339; 264/573

[58] Field of Search ..... 264/291, 292, 339, 573, 264/295, 294; 72/57, 60, 296, 302, 369, 151

[56] References Cited

U.S. PATENT DOCUMENTS

| | | | |
|---|---|---|---|
| 203,842 | 5/1878 | Leland . | |
| 567,518 | 9/1896 | Simmons et al. . | |
| 2,464,169 | 3/1949 | Bentley | 72/302 |
| 3,105,537 | 10/1963 | Foster | 72/57 |
| 3,328,996 | 7/1967 | Pin et al. | 72/301 |
| 3,673,845 | 7/1972 | Vercoglio | 72/151 X |
| 3,753,635 | 8/1973 | Barnett | 264/339 X |
| 4,462,950 | 7/1984 | Nilsson et al. | 264/292 |

FOREIGN PATENT DOCUMENTS

| | | | |
|---|---|---|---|
| 594489 | 1/1978 | Switzerland | 156/245 |

*Primary Examiner*—Jeffery Thurlow
*Assistant Examiner*—Leo B. Tentoni
*Attorney, Agent, or Firm*—Elroy Strickland

[57] ABSTRACT

A novel and improved method of deforming elongated hollow members so as to maintain uniform cross-sectional profile, uniform section thickness reduction, and minimal springback characteristics which includes superimposing in the forming process an internal fluid pressure support for the hollow member which imposes a circumferential tension thereon, a longitudinal tension which plastically elongates the member, and a transverse bending load which plastically bends the member.

5 Claims, 7 Drawing Figures

STRETCH-FORMING PROCESS

BACKGROUND OF THE INVENTION

In the metal-forming arts there are known a variety of stretch-forming techniques in which a workpiece, usually an elongated extrusion or a sheet-form member, is formed to the profile of a forming die surface in conjunction with the application to the workpiece of tension exceeding its yield point. The tension is applied along a line coinciding with a chord of the workpiece that is deformed during the forming process.

The known stretch-forming processes typically have been applied in the forming of aluminum alloy components such as elongated extrusion sections or thin section panels like those often used for aircraft fuselage skin.

One known stretch-forming process, for example, is often referred to as stretch wrapping or stretch-wrap forming and involves the application of mechanical tension to a workpiece to thereby stretch it beyond its elastic limit. Subsequently, while the tension is maintained, the workpiece is wrapped about a form die. The underlying principle of stretch-wrap forming is that the tension applied to the workpiece causes it to undergo plastic yield and the deformation imposed by the wrapping on the form die thus results in desirable modes of plastic flow of the workpiece material whereby the formed workpiece retains the desired formed shape substantially without springback. Thus, one advantage of stretch-wrap forming is that the form die profile may closely duplicate the final desired form and need not include springback compensation. Stretch-wrap forming is particularly well suited for forming a workpiece to long sweeping curvatures of liberal radii.

Other stretch-forming techniques include moving die arrangements, in which the gripping heads are stationary and the forming die is moved perpendicularly into the workpiece. Another technique is radial draw forming, in which one gripping head and the die are mounted on a table that rotates to slowly draw the part under tension over the rotating die.

Other advantages of stretch-forming processes generally include elimination of workpiece buckling and wrinkling, work-hardening of the workpiece, and penetration of the work-hardening throughout the section thickness of the workpiece. Furthermore, the desired results are achieved with only minimal reduction in workpiece section thickness, typically not exceeding a 5% reduction.

From the above, it will be appreciated that the known stretch-forming processes, and in particular the process of stretch-wrap forming, are vastly different from conventional bending processes as typified by the following prior art: U.S. Pat. Nos. 3,105,537; 203,842; 567,518; and 3,328,996, all of which relate to conventional bending operations in which bending force is applied laterally of the axis of an elongated workpiece. For example, in U.S. Pat. No. 3,105,537, the workpiece is bent by forming thereof over a die, whereas in U.S. Pat. No. 3,328,996, the bending is performed by relative lateral movement of a pair of dies which tend to deform the workpiece in a zone of shear therebetween. Each of the above-mentioned prior art patents also discloses the use of an incompressible fluid, specifically a liquid medium, confined under pressure within the hollow workpiece during bending.

Since the bending art as above characterized contemplates no significant application of tension force to the workpiece, certainly none of great enough magnitude to approach or surpass the material yield point in metal-forming operations, the differences between the mechanics of conventional bending, and the mechanics of stretch forming, are considerable.

BRIEF SUMMARY OF THE INVENTION

The present invention contemplates a novel and improved stretch forming process in which an internal support of pressurized fluid is provided within the hollow interior of an extrusion that is undergoing stretch forming. The internal fluid pressure is maintained at relatively low levels, on the order of 15 to 50 psi, for example, and in any event far lower than the magnitude of pressure which would be required to have any significance in terms of mechanical working of the workpiece material during forming thereof. Nevertheless, this moderate internal pressure is sufficient to maintain the workpiece section shape during forming. This is especially beneficial when working with thin-walled members whose outer wall might tend to collapse inwardly during the forming process.

Preferably, the pressure fluid is air or other suitably compressible gaseous medium which is admitted under pressure into the interior of the workpiece via a port formed in one of a pair of plugs that seal the open ends of the workpiece.

The use of air provides fast and efficient development of internal workpiece support and ease of pressure fluid disposal after the forming operation is completed. Furthermore, the advantages of light weight and utilization of existing resources (most plants have pressurized air capability in place) are realized. The advantages over prior internal supports (e.g., solid support provided by articulated mandrels) thus are considerable.

Accordingly, it is one general object of this invention to provide a novel and improved method of metal-forming.

A more specific object of the invention is to provide a novel process for forming of elongated, hollow workpieces such as extrusions in which a fluid pressure of sufficient magnitude to maintain the section shape of the extrusion is provided within the extrusion and is maintained therein during a stretch forming operation.

BRIEF DESCRIPTION OF THE DRAWINGS

These and other objects and further advantages of the invention will be more readily understood upon consideration of the following detailed description and the accompanying drawings, in which.

A PREFERRED EMBODIMENT

Figure 1:
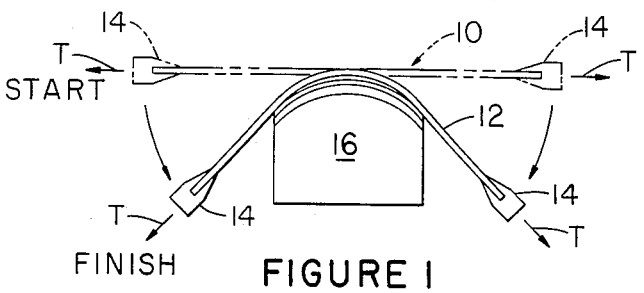
FIGURE 1 (PRIOR ART)
FIG. 1 is a generally schematic view of a conventional stretch-wrap forming process and apparatus.

There is generally indicated at 10 in FIG. 1 a fragmentary portion of a conventional prior art stretch-wrap forming apparatus which is utilized to form an elongated workpiece 12 to a desired shape. The invention, however, is also employable in moving die and rotating table types of systems.

For purposes of simplification and clarity, apparatus 10 is shown in schematic form. Apparatus 10 comprises a pair of spaced-apart grippers 14 which are initially aligned in the position designated by phantom lines and labeled "start." The grippers 14 secure the opposite ends of workpiece 12 and suitable known tension means such as hydraulic piston-cylinder assemblies (not shown) apply to the workpiece a tension T of sufficient magnitude to exceed the elastic limit of the workpiece. While tension T is maintained, the grippers 14 are rotated in suitable known adjustable mountings (not shown) to the position designated "finish" to form the workpiece 12 over a forming die 16. Throughout the forming process the tension T is maintained in alignment with a chord extending longitudinally of the workpiece 12.

Figure 2:
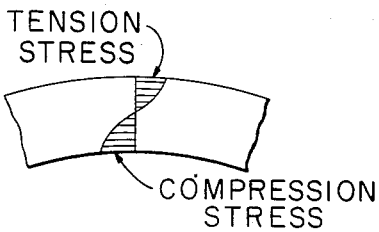
FIG. 2 is a simplified stress diagram of the stresses imposed on a workpiece in a conventional bending process.
Figure 3:
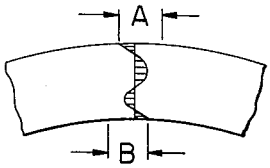
FIG. 3 is a simplified stress diagram showing the residual stresses in a formed workpiece after conventional bending.

FIGS. 2 through 5 are illustrative of some of the differences between conventional stretch-wrap forming as above characterized, and conventional bending. When a pure bending load is applied to a workpiece, the material on the radially inner side of the neutral chord or axis is placed in mechanical compression while the material on the opposite or radially outer side of the neutral axis is placed in mechanical tension as shown in FIG. 2. With sufficient bending load, the tensile and compressive stresses will at certain locations exceed the elastic limit of the workpiece material and plastic deformation will occur. Upon release of the bending load, the workpiece will incrementally resile or spring back to thereby establish a condition of stress equilibrium in which residual, balanced tensile and compressive stresses are retained within the workpiece on both sides of a neutral chord as shown in FIG. 3. In conjunction with the springback, the radially outer surface will shorten incrementally upon relaxation of the bending load while the radially inner surface will elongate upon relaxation of the load. The magnitude of springback is related to the elastic limit of the material being formed.

Figure 4:
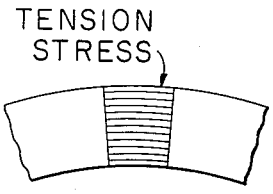
FIG. 4 is a simplified stress diagram of the stresses imposed on a workpiece during conventional stretch-wrapping.
Figure 5:
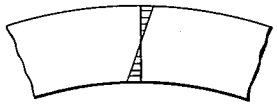
FIG. 5 is a simplified stress diagram showing the residual stresses in a formed workpiece after conventional stretch-wrap forming.

From FIGS. 4 and 5, it will be seen that the stress loading imposed on a workpiece during conventional stretch-wrap forming differs markedly from that occurring during a pure bending operation. Specifically, as shown in FIG. 4 stretch-wrap forming imposes pure tension across the cross section of the workpiece, with the stress lines following the curvature of the workpiece as it is progressively formed over the forming die. Accordingly, when the tension load exceeds the elastic limit and the material enters the plastic range, the workpiece elongates plastically across its entire cross section. Thus, when the forming loads are removed, most springback is tangential and very little change in radius occurs as a result. Furthermore, the residual stresses are considerably simpler than for pure bending, as a comparison of FIGS. 3 and 5 shows.

This invention relates to a process for stretch forming an elongated, hollow workpiece such as an aluminum extrusion by pressurizing the interior of the workpiece with a pressure fluid medium, preferably a compressible gaseous medium such as air, and maintaining the internal pressure as an internal support for the workpiece during stretch forming thereof to ensure uniform forming over the die without collapse or other irregular deformation of the workpiece cross-sectional profile. The invention is most advantageous for forming relatively thin-walled hollow extrusions and for extrusions of regular or irregular cross-sectional shape.

Figure 6:
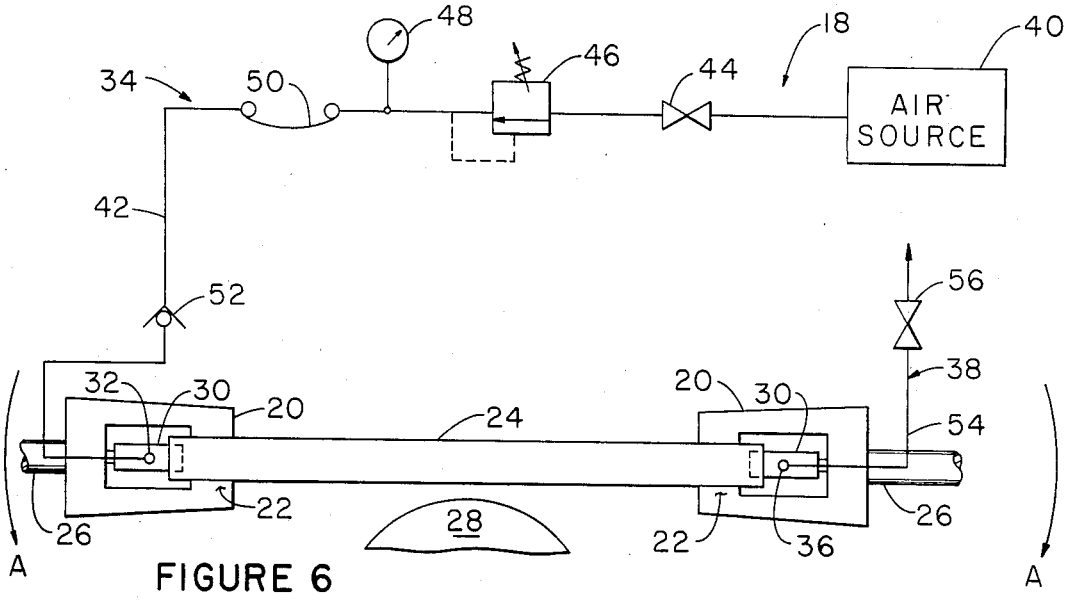
FIG. 6 is a simplified schematic illustration of an apparatus for performing the novel stretch-wrap forming process of this invention on a hollow, elongated workpiece.

Accordingly, in FIG. 6 there is schematically shown a stretch-wrap forming apparatus 18 comprised of a pair of adjustably mounted gripper assemblies 20 having jaws 22 which are adapted to selectively grip the respective opposite ends of an elongated, hollow workpiece 24. Gripper assemblies 20 are mounted on suitably adjustable and well-known carriers, shown partially at 26 as the outer ends of piston rod portions of hydraulic cylinder assemblies (not shown). The cylinder assemblies carry the grippers 20, and in turn are carried by well-known adjustable mountings (not shown) to permit rotary movement thereof with respect to a forming die 28.

The piston rods 26 cooperate with the cylinders (not shown) to impose a tension load of a selected magnitude upon workpiece 24 while rotary movement of the grippers 20 and their supports as indicated by arrows A forms the workpiece 24 over the forming die 28.

Each gripper assembly 20 incorporates a plug member 30 which is of a cross-sectional form and size to be sealingly interengaged with the respective open end of workpiece 24. An air inlet port 32 in one plug 30 cooperates with a pressure air supply system 34 to provide for internal pressurization of the workpiece 24 and an exhaust port 36 in the other plug 30 cooperates with an air bleed line 38 to exhaust pressurized air from workpiece 24.

Both the air supply system 34 and exhaust system 38 may be of entirely conventional construction. For example, air supply system 34 comprises a source 40 such as a compressor which is connected via a conduit 42 with inlet port 32. Interposed serially in the flow path defined by conduit 42 are such requisite conventional flow directing and control elements as a stop valve 44, an adjustable self-clamping flow control valve 46, a pressure gage 48, a moisture trap 50 and a one-way (non-backflow) check valve 52. Exhaust line 38 may be comprised of a conduit 54 having interposed therein a manually-operable pressure bleed valve 56, for example.

Figure 7:
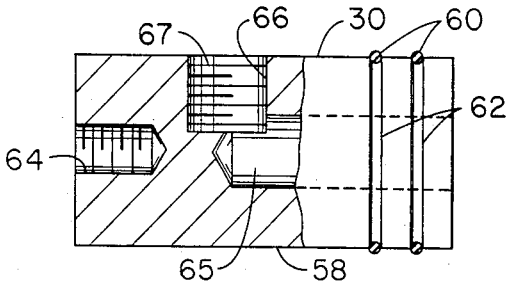
FIG. 7 is a partially sectioned side elevation of an end plug for use in conjunction with the apparatus of FIG. 6 to seal the open ends of such a hollow, elongated workpiece.

FIG. 7 depicts one of plugs 30 as an elongated rigid body member 58 having a cross-sectional form which permits the plug 30 to be sealingly received within one open end of workpiece 24. One or more O-rings 60 reside within suitable encompassing grooves 62 to provide pressure sealing engagement with the interior periphery of the workpiece 24.

A threaded blind bore 64 receives a stud member (not shown) carried by gripper assembly 20 to thereby secure plug 30 with respect to gripper 20, and a pair of partially-intersecting, mutually-perpendicular blind bores 65, 66 provide a flow path between the interior and the exterior of workpiece 24 when the plug 30 is installed in the open end thereof. Bore 66 is prepared, as by suitable internal threads 67 for pressure-tight connection to one of conduits 42 or 54.

By use of such apparatus as above specified, the improved forming process may be practiced as follows. First, plugs 30 corresponding to the interior cross-sectional profile of a selected workpiece 24 are installed on gripper assemblies 20. The workpiece 24 is then positioned with plugs 30 received within the opposite ends thereof and the jaws 22 of grippers 20 are actuated to grab the respective workpiece ends.

With bleed valve 56 closed, the air supply system is actuated to provide pressurized air to the interior of workpiece 24, for example a pressure in the range of 15 to 30 psi. While the interior air pressure is maintained, the gripper carriers, shown as hydraulic ram pistons 26, are actuated to impose on workpiece 24 an axial tension of sufficient magnitude to initiate plastic elongation of the workpiece. While both the internal air pressure and the mechanically-applied longitudinal tension are maintained, the mountings for grippers 20 are suitably adjusted to form workpiece 24 over the forming die 28. The longitudinal tension imposed on workpiece 24 provides for enhanced stress patterns while the contained air pressure provides flexible interior support which helps to ensure maintenance of a uniform cross-sectional profile throughout the length of the workpiece.

More specifically, the internal pressure imposes radially-outwardly directed restraining forces on the interior periphery of the workpiece. This results in a predetermined level of circumferential tension as well as limited longitudinal tension in the workpiece. The pressure is sufficient to maintain a uniform cross-sectional profile during forming, but is insignificant as a source of stress to produce bending loads. The mechanically-applied tension imposed through load grippers 20 imposes longitudinal tension uniformly over the entire cross section of the workpiece, while the bending load imposes stress varying from tension to compression across the neutral axis of the workpiece. These three modes of stress are superimposed in the forming operation to provide a novel and improved forming process. The method of the invention thus provides for improved ease, efficiency and reliability in a stretch forming operation as applied to hollow, elongated workpieces.

It is to be appreciated that the inventors have envisioned and anticipated various modifications and alternative embodiments other than the above-described preferred embodiment. Therefore, it is intended that the invention be construed broadly and limited only in accordance with the scope of the claims appended hereto.

What is claimed is:

1. A method of plastically forming an elongated hollow metal member having walls capable of containing a compressible fluid under pressure, the method comprising the steps of:

providing internal support within the hollow interior of the member by exposing the hollow interior thereof to a compressible fluid medium to impose a outwardly directed force uniformly over the interior periphery thereof at a pressure insufficient to cause mechanical working of the walls of the member;

while maintaining said internal support, mechanically gripping the opposite longitudinal ends of the member and forcibly pulling said opposite ends in opposite longitudinal directions to thereby apply to the member a longitudinal tension of sufficient magnitude to exceed the elastic limit of the member and initiate elongation through plastic deformation thereof;

while continuing to maintain said internal support and longitudinal tension bending the member intermediate of its ends in a direction transversely of the direction of the longitudinal tension; and relaxing said longitudinal tension, said bending load, and said internal support.

2. The method as claimed in claim 1 wherein said providing internal support includes disposing sealing plug means within open longitudinal ends of the member to seal the interior of the member from the ambient atmosphere.

3. The method as claimed in claim 2 wherein said providing internal support further includes providing said pressure via port means in said plug means.

4. The method as claimed in claim 1 wherein in said providing internal support, said maintaining, and said further maintaining steps are performed on a hollow member of geometrically-regular or irregular cross-sectional form.

5. A method of forming an elongated, hollow, open-ended metal member having walls capable of containing a compressible fluid under pressure, the method comprising the steps of:

disposing sealing plug means in the open ends of the member to seal the hollow interior of the member from the ambient atmosphere;

supplying compressible pressure medium to the sealed interior of the member via at least one of said plug means to impose on the member a circumferential tension load of a magnitude insufficient to result in mechanical working of the member yet sufficient to provide internal support for the walls of the member when the member is subjected to bending and stretching;

engaging the opposite longitudinal ends of the member adjacent said plug means with gripping means and pulling said gripping means in opposite longitudinal directions to superimpose on said circumferential tension a uniform longitudinal tension load of sufficient magnitude to elongate the member beyond its yield point;

simultaneously with said supplying and said pulling steps, moving said gripping means transversely of the direction of said pulling in a manner to move the member laterally into interfering contact with a forming die to impose on the member a transverse bending load of sufficient magnitude to laterally bend the member beyond its yield point;

relaxing said uniform longitudinal tension load and said bending load;

and subsequently releasing said compressible medium from the sealed interior of the hollow member to relax said circumferential tension load.

* * * * *